United States Patent [19]

Butler

[11] 4,085,803

[45] Apr. 25, 1978

[54] METHOD FOR OIL RECOVERY USING A HORIZONTAL WELL WITH INDIRECT HEATING

[75] Inventor: Roger Moore Butler, Calgary, Canada

[73] Assignee: Exxon Production Research Company, Houston, Tex.

[21] Appl. No.: 777,293

[22] Filed: Mar. 14, 1977

[51] Int. Cl.[2] ..... E21B 43/24

[52] U.S. Cl. ..... 166/303; 166/50; 166/57

[58] Field of Search ..... 166/272, 303, 302, 256, 166/259, 50, 57, 60, 263; 299/2

[56] References Cited

U.S. PATENT DOCUMENTS

| | | | |
|---|---|---|---|
| 1,816,260 | 7/1931 | Lee | 166/303 |
| 2,857,002 | 10/1958 | Pevere et al. | 166/303 |
| 3,338,306 | 8/1967 | Cook | 166/50 X |
| 3,474,863 | 10/1969 | Deans et al. | 166/272 X |
| 3,768,559 | 10/1973 | Allen et al. | 166/272 |
| 3,838,738 | 10/1974 | Redford et al. | 166/272 X |
| 3,954,140 | 5/1976 | Hendrick | 166/50 |
| 3,986,557 | 10/1976 | Striegler et al. | 166/303 X |
| 3,994,340 | 11/1976 | Anderson et al. | 166/50 X |
| 4,006,778 | 2/1977 | Redford et al. | 166/303 X |
| 4,020,901 | 5/1977 | Pisio et al. | 166/50 |

*Primary Examiner*—Stephen J. Novosad
*Attorney, Agent, or Firm*—Gary D. Lawson

[57] ABSTRACT

Disclosed is a method for recovering hydrocarbons from a subterranean formation. A heated fluid is injected into the formation by means of a perforated conduit which is positioned substantially horizontally through the formation to heat hydrocarbons within the formation. After a suitable heating period, injection of heat is terminated to permit fluids including formation hydrocarbons to drain from the formation into the conduit. The drained fluids within the conduit are then heated to a temperature such that at least a portion of the drained fluids are vaporized. These vaporized fluids pass from the perforated conduit and into the formation to further heat formation hydrocarbons. Subsequently, formation fluids of reduced viscosity are recovered from the formation through the perforated conduit.

16 Claims, 1 Drawing Figure

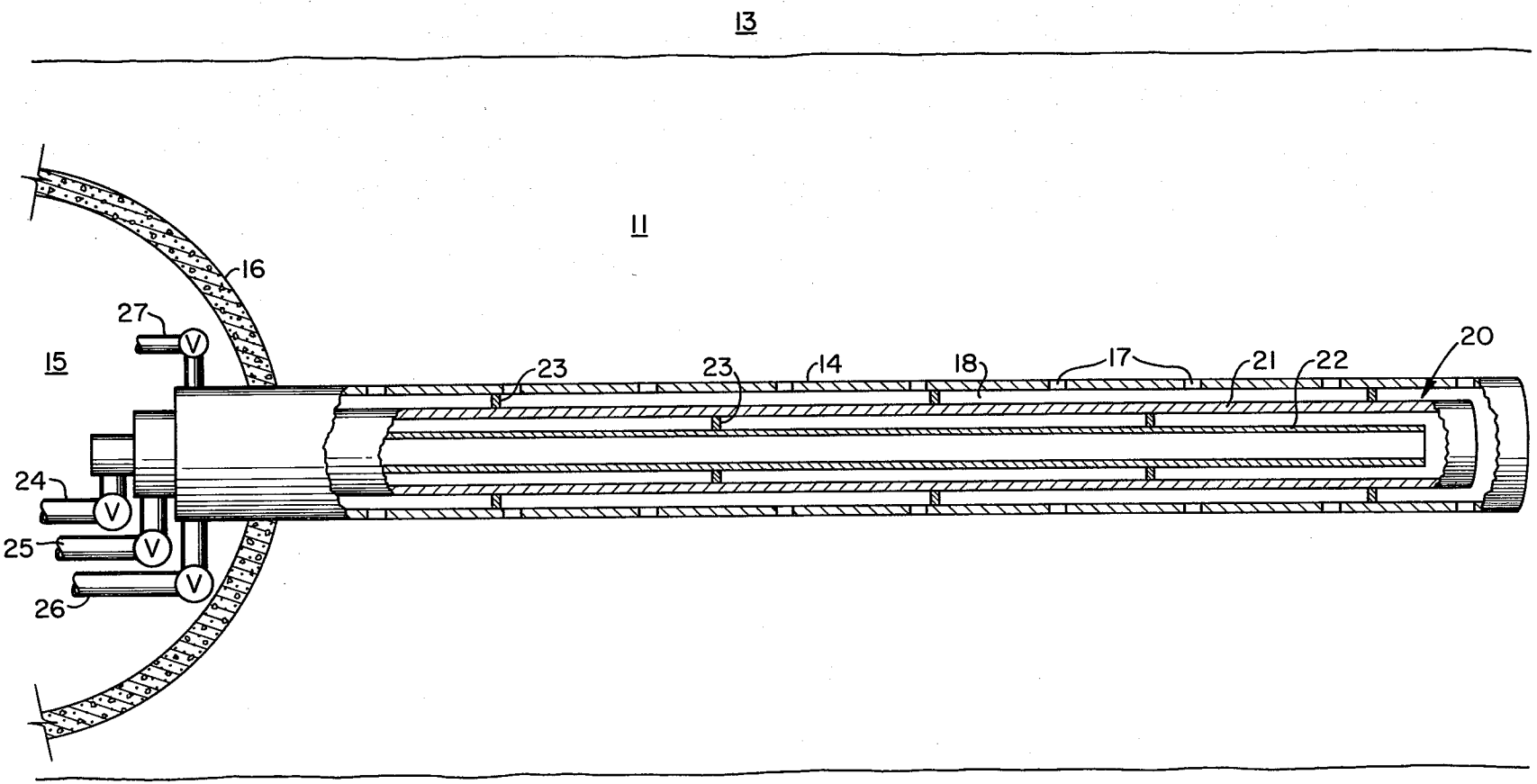
13
11
20
22
21
17
18
14
23
23
16
27
15
24
25
26

METHOD FOR OIL RECOVERY USING A HORIZONTAL WELL WITH INDIRECT HEATING

BACKGROUND OF THE INVENTION

1. Field of the Invention

This invention relates to a process including a shaft or deep boring in the earth, commonly known as wells, for the extraction of fluids from the earth. More particularly, this invention relates to a process for recovering hydrocarbons from a subterranean formation using a well or wells for injection and production and including heating steps.

2. Description of the Prior Art

In many areas of the world, there are large deposits of viscous petroleum. Examples of viscous petroleum deposits include the Athabasca and Peace River regions in Canada, the Jobo region in Venezuela and the Edna and Sisquoc regions in California. These deposits are generally called tar sand deposits due to the high viscosity of the hydrocarbons which they contain. These tar sands may extend for many miles and may occur in varying thickness of up to more than 300 feet. Although tar sands may lie on or near the earth's surface, generally they are located under an overburden which ranges in thickness from a few feet to several thousand feet. The tar sands located at these depths constitute one of the world's largest presently known petroleum deposits.

The tar sands contain a viscous hydrocarbon material, which is generally referred to as bitumen, in an amount which ranges from about 5 to about 20 percent by weight. This bitumen is usually immobile at typical reservoir temperatures. For example, at reservoir temperatures of about 48° F, bitumen is immobile, having a viscosity frequently exceeding several thousand poises. At higher temperatures, such as temperatures exceeding 200° F, the bitumen becomes mobile with a viscosity of less than 345 centipoises.

In situ heating is among the most promising methods for recovering bitumen from tar sands because there is no need to move the deposit and because thermal energy can substantially reduce the viscosity of bitumen. The thermal energy may be introduced into the tar sands in a variety of forms. For example, hot water, in situ combustion, and steam have been suggested to heat tar sands. Although each of these thermal energy agents may be used under certain conditions, steam is generally the most economical and efficient.

Thermal stimulation processes are among the most promising of the in situ methods for heating tar sand formations. In one process, commonly referred to as the "huff and puff" process, steam is injected through a well and into a viscous hydrocarbon deposit for a period of time. The well is then shut in to permit the steam to heat the oil. Subsequently, the well is placed on production.

To accelerate the input of heated fluids into the formations, it has been proposed to drill horizontally deviated wells or to drill lateral holes outwardly from a main borehole or tunnel. Examples of various thermal systems using horizontal wells are described in U.S. Pat. Nos. 1,634,236, Ranney; 1,816,260, Lee; 2,365,591, Ranney; 3,024,013, Rogers et al.; 3,338,306, Cook; 3,960,213, Striegler et al.; 3,986,557, Striegler et al.; Canadian Pat. No. 481,151, Ranney; and German Pat. No. 1,163,750, Heuckeroth. However, injection of heated fluids into tar sand formation through horizontal wells has not been developed commercially. One difficulty with these prior art methods is that hydrocarbons do not flow into the horizontal well in economic quantities.

There is a substantially unfilled need for an improved thermal method for effectively recovering viscous hydrocarbons from subterranean formation.

SUMMARY OF THE INVENTION

In accordance with the practice of this invention, hydrocarbons are recovered from a subterranean formation by the following method. A heated fluid is injected into the formation by means of a perforated conduit which is disposed in a substantially horizontal manner within the formation to heat hydrocarbons within the formation and to render the hydrocarbons more flowable. Injection of the heated fluid is then terminated to permit formation fluids, including the heated formation hydrocarbons, to flow into the perforated conduit. Subsequently, formation fluids within the perforated conduit are heated to a temperature sufficient to vaporize at least a portion of said formation fluids to cause such vaporized fluids to pass from the perforated conduit into the formation. These vaporized fluids further heat the formation hydrocarbons to render the hydrocarbons more flowable. Heated formation fluids including heated formation hydrocarbons are then withdrawn from the formation by means of the perforated conduit.

In the practice of the preferred embodiment of this invention, a perforated conduit is extended substantially horizontally into a tar sand deposit from a tunnel which is disposed near the bottom of the tar sand deposit. Disposed in the perforated conduit are dual concentric conduits which comprise an inner conduit and a surrounding larger diameter intermediate conduit. The intermediate conduit and the perforated conduit cooperate to form an annular space and the inner conduit and the intermediate conduit cooperate to provide a continuous enclosed fluid flow path through the intermediate conduit. Steam and optionally a solvent is injected into the formation through the annular space to reduce the viscosity of formation hydrocarbons. After a suitable injection interval, formation fluids are permitted to drain into the annular space. Subsequently, steam or another heating medium is passed through the intermediate conduit to heat indirectly the drained fluids in the annular space. During this indirect heating, additional steam or hydrocarbon vapors are produced by boiling and these vapors pass into the surrounding reservoir heating and diluting the bitumen therein. After a suitable indirect heating period, formation hydrocarbons are drained from the annular space to the tunnel and are pumped through suitable conduits to a processing unit.

The practice of this invention enhances drainage of viscous hydrocarbon into the horizontal well. The invention will therefore be seen to offer significant advantages over conventional methods for recovering viscous hydrocarbons.

BRIEF DESCRIPTION OF THE DRAWING

The FIGURE is a vertical cross-sectional view illustrating a completion assembly for a horizontal conduit extending from a tunnel into a tar sand deposit.

DESCRIPTION OF THE PREFERRED EMBODIMENTS

Referring to the FIGURE, a description of the preferred embodiment of the method of this invention will be described in an unconsolidated tar sand formation. A subterranean formation 11 is shown which contains tar sands such as Athabasca tar sands, disposed below the earth's surface (not shown), beneath an overburden 13.

As the first step of this embodiment, a perforated conduit 14 is disposed in the tar sand deposit 11. The FIGURE illustrates a substantially horizontal conduit 14 which extends from a tunnel 15 which is positioned approximately transverse to the conduit 14. The tunnel wall 16 may be composed of any suitable material such as cement to prevent unrestricted fluid communication between the tunnel and the formation. The perforated conduit 14 is positioned through the tunnel wall and is sealed to the wall in any convenient manner to prevent unrestricted ingress of fluid into the tunnel. The perforated conduit 14 may be extended into the tar sands by any conventient means. For example, a wellbore may be drilled and a perforated liner may then be inserted into the well or the conduit may be driven into the formation with a vibrator. The art of forming tunnels in tar sands and of extending horizontal conduits from tunnels is well known.

The conduit 14 contains slots or perforations 17 to provide fluid communication between the interior of the conduit and the tar sand deposit. Inlet and outlet pipes 26 and 27 provide fluid communication into and out of the conduit 14. Disposed within the perforated conduit 14 is a heater assembly 20 which comprises dual concentric pipes 21 and 22. The pipe 21 extends substantially the entire length of conduit 14 and is closed at the end which is remote from the tunnel. Pipe 21 cooperates with the perforated conduit 14 to form an annular space 18. Pipe 22 is disposed coaxially within pipe 21 and is open at the end remote from the tunnel. Centralizer baffles 23 are installed at various intervals in the annular spaces between the pipe 21 and perforated conduit 14 and between the pipe 21 and pipe 22 to centralize pipe 22 within pipe 21 and to centralize pipe 21 within the perforated conduit 14. These centralizers are not continuous and they do not block fluid flow in the annular space. Pipes 21 and 22 cooperate with each other to form a continuous enclosed fluid flow path. Fluids may be introduced into either pipe 21 or pipe 22 and will exit through the other of these pipes. Supply of fluids to and from pipes 21 and 22 is accomplished by conduits 24 and 25 which are connected through suitable piping (not shown) to a source of heated fluid.

After the perforated conduit is suitably completed, a heated fluid is injected into the formation through conduit 14. Referring to the FIGURE, the heated fluid enters conduit 14 via pipe 27 and passes through passage 17 into the formation. The heating fluid may be any suitable fluid which is capable of heating bitumen in the formation to a sufficient temperature to cause the bitumen to gravitate downwardly into the conduit 14. For example, the fluid may be steam or may be a solvent vapor or may be a mixture of steam and air, or a mixture of steam and solvent such as carbon disulfide, hydrogen sulfide, naphtha, cracked naphtha, $C_3$, $C_4$, or $C_5$ hydrocarbons, toluene, xylene or benzene.

Following a suitable injection period, the heated fluid injection is discontinued and formation fluids including bitumen are permitted to drain into the annular space. Heated fluid is then circulated through pipes 21 and 22 to indirectly or conductively heat the fluids in annular space 18. Circulation of heated fluid through pipes 21 and 22 is continued with the fluid at a temperature sufficient to vaporize a portion of the drained fluids. The temperature of the circulated heated fluid will depend upon the boiling temperature in the annular space. This boiling temperature will typically range from about 250° F to about 750° F. The heated fluid in conduits 21 and 22 has a temperature higher than the fluids in annular space 18.

After a suitable indirect heating interval, bitumen is recovered from the formation by allowing it to drain through annular space 18 into conduit 26 from which it is pumped through suitable conduits to a conventional processing unit or is passed to storage.

The heated fluid circulated through heating assembly 20 may be any heat carrying gas or liquid which is capable of boiling fluids in annular space 18. Steam is suitable because it is relatively economical to produce and the temperature of the steam in the heater assembly will be substantially uniform throughout. In some cases other heat transfer agents such as diphenyl/diphenyl oxides mixtures may be preferable.

The diameter and length of the perforated conduit 14 will depend on the characteristics of the formation, conventional drilling criteria and economics of a given situation. However, the perforated conduits are typically from about 7 to 18 inches in diameter and from about 200 to 9000 feet in length.

To best exploit the effects of gravity in recovering the bitumen, the slotted or perforated conduit should be formed towards the bottom of the hydrocarbon-bearing formation. The production rate will usually be enchanced by locating the perforated conduit 10 to 50 feet above the bottom of the bitumen bearing zone. In addition, the borehole should be drilled slightly downward or upward depending on the well completion apparatus, to facilitate production of the bitumen to the earth's surface. With the configuration shown in the FIGURE, the borehole should slope upwards from the tunnel so as to allow gravity to move liquids towards the tunnel.

The composition of the liner and the concentric tubing string is a function of such factors as the type of injected fluid, flow rate, temperature, and pressure employed in a specific operation. The materials of construction may be the same or different, and may be selected from a wide variety of materials, including steel. The perforations in the casing would normally start several feet from the tunnel in order to reduce heating of the tunnel itself.

The steam injected into the formation, in the practice of this invention, can be generally high or low quality steam. Preferably, the steam is at least 50% quality and more preferably from about 70 to 100 percent. The steam may be mixed with noncondensable gases such as air or flue gas, or with solvents such as methane, ethane, propane, butane, pentane, naphtha, cracked naphthas, kerosene, carbon dioxide, carbon disulfide or hydrogen sulfide. A mixture of volatile solvents and steam will increase hydrocarbon drainage into the well. Volatile solvents injected into the formation with the steam will flow upwards into the formation to dilute the bitumen and thereby aid in reducing its viscosity. These solvents will tend to accumulate and reflux within the hot zone of the reservoir. Thus, the hot zone of the formation may contain relatively high concentrations of solvent with only a relatively small concentration of solvent injected with the steam. This is particularly important if reactive solvents such as hydrogen sulfide are to be employed.

The temperature of the fluid injected into the formation can be of any suitable temperature which is capable of mobilizing bitumen in the tar sand formation. In many instances, it will be desirable that the hot fluid have a temperature between about 250° F and about 600° F. Although operation with colder fluids is possible, this will tend to increase the requirements for indirect heat.

It should be understood any type of heating means which is capable of vaporizing fluids in the perforated conduit 14 can be used in the practice of this invention. A heating means such as an electrical heater can be associated with or located within the perforated conduit. The invention is, therefore, not limited to the heater assembly as described for the preferred embodiment.

The indirect heating of fluids in the annular space 14 facilitates drainage of bitumen into the well during the indirect heating stage. At least a portion of the water and hydrocarbons in the conduit are vaporized. The steam and hydrocarbon vapors help carry heat from the well into the formation and reduces viscosity of a larger amount of bitumen in the well.

The indirect heating stage of this invention also facilitates hydrocarbon drainage into the well by increasing the oil saturation in the reservoir pore spaces around the well. In conventional steam stimulation processes, the steam injection into the well tends to strip the oil on the reservoir pore spaces adjacent the well. These pore spaces then become water saturated and flow of oil into the well from the reservoir is restricted because of capillary pressure effects. During the indirect heating stage, however, the water in at least part of these pore spaces is vaporized and oil is permitted to occupy these spaces.

In another embodiment of this invention, after a heated fluid has been injected into the formation for a suitable time interval, formation fluids including bitumen may be produced from the formation by means of conduit 14. When production rates decrease to an uneconomical level, production is stopped and heated fluid is circulated through pipes 21 and 22 to indirectly heat the fluids in annular space 18. After a suitable indirect heating interval, bitumen is again produced from the formation by means of conduit 14.

In the broadest aspect of this invention, the conduit 14 can be disposed in any subterranean formation. The conduit can be extended, for example, from a vertical or deviated borehole which extends into the deposit, from a deposit which outcrops along a cliff, from a trench which extends from the earth's surface into the tar sands, or from a tunnel which is formed in the formation as illustrated in the FIGURE. Other means, of course, can be used to provide an exposed working surface.

Although the invention has been described in connection with the recovery of hydrocarbons from subterranean tar sand formations, it is also within the scope of this invention to employ the apparatus and method described herein to recover any liquids from any subterranean strata which can be stimulated by thermal energy. This invention can also be employed to recover hydrocarbons of much higher API gravity, e.g. 25° to 40° API.

FIELD EXAMPLE

This invention may be better understood by reference to the following example which is offered only as an illustrative embodiment of the invention and is not intended to be limited or restrictive thereof.

A tar sand formation is located at a depth of 1420 feet and has a thickness of 75 feet. The hydrocarbon viscosity is so high that it is almost immobile at the formation temperature. The formation temperature is 40° F and the formation pressure is 600 psig and the formation permeability is 2000 millidarcies.

A tunnel is formed in the tar sand formation along the bottom thereof by conventional means. A wellbore is drilled in an upward direction 1° from the horizontal into the formation for a distance of 2000 feet. Referring to FIG. 1, the well is completed with a steel liner which is slotted from a distance of 100 feet from the tunnel to the end. The liner slots 17 are about 0.03 inches in width. Dual concentric tubing string 21 and 22 are positioned in the liner and extend to approximately the entire length of the liner. Centralizers 23 centralize conduit 21 coaxially within liner 14 and centralize conduit 22 coaxially within conduit 21. Conduit 21 cooperates with perforated conduit 14 to form the annular space 18. Conduit 22 has a 3½ inch diameter and conduit 21 has a 5½ inch diameter and perforated conduit 14 has a 12 inch diameter. After completion of the perforated conduit, steam is introduced into the annular space 18 at a pressure of 1000 pounds per square inch for 10 hours. Steam injection is then discontinued and the well is shut in for 3 hours. During this soak period, the bitumen and steam condensate drain into the annular space 18. Subsequently, steam is circulated through conduit 22 into the annular space between conduits 21 and 22, and steam condensate is withdrawn through conduit 25. The steam is circulated at a pressure of 1000 psi for about 1 hour. Bitumen is then allowed to drain through annular space 18 through conduit 26 and then to storage or other production facilities. At the end of the production cycle, the steps of injecting steam in the formation, allowing the formation fluids to drain into the annular space, heating indirectly the formation fluids to force at least a portion of fluids into the formation, and recovering the fluids are repeated with each cycle length being increased until the reservoir being treated is depleted to the point where further production is no longer economically feasible.

Various modifications and alterations of this invention will become apparent to those skilled in the art without departing from the scope and spirit of this invention, and it should be understood that this invention is not to be unduly limited to that set forth herein for illustrative purposes.

What I claim is:

1. A method for recovering hydrocarbons from a subterranean formation comprising injecting a heated fluid into the formation by means of a perforated conduit which is disposed in a substantially horizontal manner within the formation to heat hydrocarbons within the formation to render the hydrocarbons more flowable;

terminating injection of the heated fluid into the formation to permit formation fluid including the heated formation hydrocarbons to flow into the perforated conduit;

heating the formation fluids within the perforated conduit to a temperature sufficient to vaporize at least a portion of said formation fluids to cause such vaporized fluids to pass from the perforated conduit and into the formation to further heat formation hydrocarbons to render the hydrocarbons more flowable; and withdrawing heated formation fluids including heated formation hydrocarbons from the formation by means of the perforated conduit.

2. The method as defined in claim 1 wherein the heated fluid is steam.

3. A method as defined in claim 1 wherein the fluid injected into the formation is selected from the group consisting of steam, solvent vapors, a mixture of steam and air, or a mixture of steam and solvent.

4. The method as defined in claim 3 wherein the solvent is selected from the group consisting of carbon disulfide, hydrogen sulfide, naphtha, cracked naphtha, toluene, xylene or benzene.

5. The method as defined in claim 1 further comprising repeating the steps of injecting a heated fluid into the formation, terminating fluid injection to permit formation fluids to drain into said conduit and heating the formation fluids within in said conduit.

6. The method as defined in claim 1 wherein the formation fluids within the perforated conduit are heated by a heating means.

7. The method as defined in claim 6 wherein the heating means heats substantially the entire portion of the perforated conduit.

8. The method as defined in claim 1 further comprising before heating the formation fluids within the perforated conduit, withdrawing formation fluids including heated formation hydrocarbons from the formation by means of the perforated conduit.

9. A method for recovering viscous hydrocarbons from a subterranean formation containing viscous hydrocarbons comprising positioning a perforated first conduit substantially horizontally into the formation;

disposing inside the perforated conduit dual concentric conduits comprising an inner conduit and a surrounding larger diameter intermediate conduit, said intermediate conduit and said perforated conduit cooperating to form an annular space, said inner conduit and said intermediate conduit cooperating to provide continuous enclosed fluid flow path through said inner and intermediate conduits;

injecting a heated fluid into the formation through said annular space and thereby reducing the viscosity of the formation hydrocarbons;

permitting fluids including formation hydrocarbons to drain into said annular space;

circulating a heated fluid through said inner and intermediate conduits to heat indirectly the drained fluids in said annular space; and recovering the formation hydrocarbons from said annular space.

10. The method as defined in claim 9 wherein the heated fluid injected into the formation is steam.

11. A method as defined in claim 9 wherein the heated fluid injected into the formation is selected from the group consisting of steam, a mixture of steam and air, or a mixture of steam and solvent.

12. The method as defined in claim 11 wherein the solvent is selected from the group consisting of carbon disulfide, hydrogen sulfide, naphtha, $C_3$, $C_4$, or $C_5$, hydrocarbons, toluene, xylene or benzene.

13. In a method for recovering viscous petroleum including bitumen from a subterranean viscous petroleum containing formation including a tar sand deposit, said formation being penetrated by a perforated conduit which extends substantially horizontally therethrough, said perforated conduit being completed by dual concentric conduits comprising an inner conduit and a surrounding larger diameter intermediate conduit, said intermediate conduit and said perforated conduit cooperating to form an annular space, said inner conduit and said intermediate conduit cooperating to provide a continuous enclosed fluid flow path through said inner and intermediate conduits, said recovery method being of the type wherein a fluid is injected into the well for the purpose for increasing the mobility of petroleum contained in the formation, the improvement which comprises injecting a heated fluid into the formation through said annular space and thereby reducing the viscosity of the formation hydrocarbons;

permitting fluids including formation hydrocarbons to drain into said annular space;

circulating a heated fluid through said inner and intermediate conduits to heat indirectly the drained fluids in said annular space; and recovering the formation hydrocarbons from said annular space.

14. The method as defined in claim 13 when the heated fluid injected into the formation of steam.

15. A method as defined in claim 13 wherein the heated fluid circulated through said inner and said intermediate conduits is steam.

16. In a method for recovering viscous hydrocarbons from a subterranean formation comprising positioning a perforated conduit substantially horizontally into said formation;

disposing in said conduit a heating means to heat fluids in said conduit;

injecting a fluid into the formation through said perforated conduit;

permitting fluids including the formation hydrocarbons to flow into said conduit;

heating said fluid in said conduit with said heating means to a temperature such that at least a portion of the drained fluid passes into said formation; and recovering formation hydrocarbons from the formation through said conduit.

* * * * *